US006611476B1

(12) United States Patent
Obasawa et al.

(10) Patent No.: US 6,611,476 B1
(45) Date of Patent: Aug. 26, 2003

(54) ELECTRONIC WATCH

(75) Inventors: Hitoshi Obasawa, Chiba (JP); Diarmuid Bland, Richardson, TX (US); Shannon Washburn, Richardson, TX (US); Brian Delaney, Richardson, TX (US)

(73) Assignees: Seiko Instruments Inc. (JP); Fossil Inc. (JP)

( * ) Notice: Subject to any disclaimer, the term of this patent is extended or adjusted under 35 U.S.C. 154(b) by 0 days.

(21) Appl. No.: 09/559,374

(22) Filed: Apr. 27, 2000

(30) Foreign Application Priority Data

Apr. 28, 1999 (JP) ..... 11-122692

(51) Int. Cl.[7] ..... G04C 19/00; G04C 9/00
(52) U.S. Cl. ..... 368/82; 368/187
(58) Field of Search ..... 368/69, 82–84, 368/185, 187, 239–242

(56) References Cited

U.S. PATENT DOCUMENTS 4,548,510 A * 10/1985 Levine ..... 368/10
5,477,508 A 12/1995 Will ..... 368/189

FOREIGN PATENT DOCUMENTS

| | | |
|---|---|---|
| GB | 2028547 | 3/1980 |
| WO | 98055023 | 12/1998 |

* cited by examiner

*Primary Examiner*—Vit Miska
(74) *Attorney, Agent, or Firm*—Adams & Wilks

(57) ABSTRACT

An electronic watch has a help switch for switching between a help state and a non-help state, an input circuit for converting the state of the help switch into switch information, and a help information storage circuit for storing help information to be transferred to a user. A set information storage circuit stores a setting condition of the electronic watch. A help information selection circuit selects help information from the help information stored in the help information storage circuit in accordance with switch information from the input circuit and the setting condition stored in the set information storage circuit. A help information output circuit outputs the help information selected by the help information selection circuit. An indication drive circuit converts the help information outputted from the help information output circuit into an indication drive signal. An indicator indicates the indication drive signal of the indication drive circuit.

19 Claims, 18 Drawing Sheets

FIG. 3

| MODE | CONDI-TION 1 | CONDI-TION 2 | SWITCH INFOR-MATION | CHARACTER STRING |
|---|---|---|---|---|
| TIME | LOCK | HOME TIME | C | For local time hold flashing pusher for 3 sec |
| | | | D | For chime on/off press flashing pusher |
| | | | A | For memo mode press flashing pusher |
| | | | B | To set time hold flashing pusher for 2 sec |
| | | LOCAL TIME | C | For home time hold flashing pusher for 3 sec |
| | | | D | For chime on/off press flashing pusher |
| | | | A | For memo mode press flashing pusher |
| | | | B | To set time hold flashing pusher for 2 sec |
| | SECOND CORREC-TION | | D | To reset sec digits press flashing pusher |
| | | | C | To advance to min digits press flashing pusher |
| | | | B | To set /exit press flashing pusher |
| | MINUTE CORREC-TION | | D | To (+) min digits press flashing pusher |
| | | | A | To (-) min digits press flashing pusher |
| | | | B | To advance to hour digits press flashing pusher |
| | | | C | To set /exit press flashing pusher |
| | HOUR CORREC-TION | | D | To (+) hour digits press flashing pusher |
| | | | A | To (-) hour digits press flashing pusher |
| | | | B | To advance to date press flashing pusher |
| | | | C | To set /exit press flashing pusher |
| CHRONO-GRAPH | RESET | | C | To start chrono press flashing pusher |
| | | | B | To recall lap data press flashing pusher |
| | | | A | For timer mode press flashing pusher |
| | RUN | | D | To time next lap press flashing pusher |
| | | | C | To stop chrono press flashing pusher |
| | | | B | To recall lap data press flashing pusher |
| | | | A | For timer mode press flashing pusher |
| | STOP | | B | To recall lap data press flashing pusher |
| | | | D | To reset chrono press flashing pusher |
| | | | C | To restart chrono press flashing pusher |
| | | | A | For timer mode press flashing pusher |
| TIMER | LOCK | PRESET TIMER RESET | D | To select timer press flashing pusher |
| | | | C | To start timer press flashing pusher |
| | | | A | For timer mode press flashing pusher |
| | | FREE TIMER RESET | D | To select timer press flashing pusher |
| | | | B | To set timer hold press flashing pushr for 2 sec |
| | | | C | To start timer press flashing pusher |
| | | | A | For timer mode press flashing pusher |

1d:INDICATION DATA REPRESENTING SWITCH POSITION
sp:CHARCTER-STRING POINTER
fd:FONT DATA sp :POINTER INDICATING A CHARACTER POSITION
*sp :sp INDICATED CHARACTER
fd :FONT DATA
fp :FONT ROW POSITION POINTER
*fp :ROW FONT DATA WHICH fp INDICATES
dn :DOT MATRIX POSITION "n"TH ROW DISPLAY DATA
dn +1:DOT MATRIX POSITION "n+1"TH ROW DISPLAY DATA

ELECTRONIC WATCH

BACKGROUND OF THE INVENTION

1. Field of the Invention

The present invention relates generally to electronic timepieces and, more specifically, to an electronic timepiece, such as a watch, for displaying help information.

The present invention relates to an electronic watch for displaying help information.

2. Description of the Prior Art

A functional block diagram of a conventional electronic watch is shown in FIG. 15. By operating an oscillation circuit 1501, a fixed frequency inputted to a frequency dividing circuit 1502 is divided into various frequencies and a counting circuit 1503 counts the time, chronograph, countdown timer, and the like in accordance with the signals of the divided various frequencies. The counting information counted by the counting circuit 1503 is then converted into an indication drive signal and displayed on an indicating portion 1512 due to an indication drive circuit 1511. By operating a functional switch 1505, an input circuit 1506 converts whichever switch was pressed into switch information, and a functional selection circuit, in accordance with the converted switch information and set information that is stored in the set information storage circuit 1510, selects functions such as a start-count and stop-count function of the counting circuit 1503, a correction function of the counting information, and a function of change and request output of the set information stored in the set information storage circuit 1510. A function output circuit 1507 controls the counting circuit and changes set information in the set information storage circuit 1510. Additionally, the set information is outputted by a set information output circuit 1509 and is then displayed on the indicating portion 1512 after being converted into indication drive signals due to the indication drive circuit 1511. The set information storage circuit 1510 is composed of a RAM and the counting information output circuit 1504, the function output circuit 1507, the function selection circuit 1508, and the set information output circuit 1509 are composed of a ROM by programmed microcomputers. The functions of these circuits are realized when a CPU carries out the calculation process.

In the foregoing conventional electronic watch, operations became complicated since there were only a few buttons when various functions starting with chronograph, countdown timer, and so forth were added. Hence, there is a problem in that when a user wants to use a certain function, regardless of the user's intention to operate if the user does not know how to operate, or cannot remember the operation method of that function, the user has to look into the manual for the appropriate passage and to read the manual. Moreover, there arises a problem in that even though the user would like to conduct the operation, if the user does not know how to operate, or cannot remember the operation method, the user must carry the manual around with him and if the user does not have the manual with him, the user cannot help abandoning the operation of that function. Additionally, there arises a problem in that due to operation errors, stored information such as measured data, memo, and others are erased from the storage.

SUMMARY OF THE INVENTION

In order to solve the above-mentioned problem, firstly, the present invention takes a structure which comprises: an oscillation circuit; a frequency dividing circuit for dividing the output of the oscillation circuit; a counting circuit for counting the time, chronograph, countdown timer, and the like in accordance with the various frequency signals outputted from the frequency dividing circuit; a counting information output circuit for outputting the counting information by the counting circuit to an indication drive circuit; a set information storage circuit for storing modes and various set information; at least 2 or more functional switches with several functions serving as an external operation for setting modes and various conditions, the start and stop counting of the counting circuit, and for correcting the counting information; an input circuit for converting that whichever the switch was pressed into switch information by operating a functional switch; a function selection circuit for selecting functions such as the start and stop function of the counting of the counting circuit in accordance with switch information which was converted by the input circuit and the set information stored in the set information storage circuit, the correction function of the counting information, and the function, to change and request output of set information of the set information storage circuit; a function output circuit for outputting an operation command to the counting circuit when functions to give an operating command to the counting circuit such as the start and stop function of the counting circuit, the correction function of the counting information, and the like from the function selection circuit is selected; a set information output circuit for outputting set information of the set information storage circuit to an indication drive circuit; an indication drive circuit for converting counting information outputted from the counting information output circuit and set information outputted from the set information output circuit into drive signals of the indicating portion; an indicating portion for indicating counting information and set information in accordance with the drive signals of the indication drive circuit; a help information storage circuit for storing the help information constituted by a character-string information describing the switch information and functions of the switch which is classified in accordance with the mode and setting conditions; a help information selection circuit for selecting help information stored in the help information storage circuit in accordance with the mode and various setting conditions stored in the set information storage circuit; a help information output circuit for outputting help information selected by the help information selection circuit to the indication drive circuit; and a help switch serving as an external operation for requesting help information.

When a user operates the help switch, the mode and setting conditions immediately before the help switch stored in the set information storage circuit is operated are inputted to the help information selection circuit. Next, the help information selection circuit selects the help information relevant to the above-mentioned mode and setting conditions from the help information storage circuit. Then, the above selected help information is outputted to the help information circuit and indicated on the indicating portion through the indication drive circuit.

Secondly, in addition to the first structure of the present invention, the present invention takes a structure which comprises: a help information counting circuit for counting the frequency of completion of outputting help information and a help information counting comparison circuit for comparing the repeat frequency of help information output stored in the set information storage circuit with the count value of help information counting circuit, to thereby, if the count value is coincident therewith, output an output stop command of the help information, while if the count value is not coincident therewith, to return to the initially indicated help information to repeatedly request an output of the help information, By storing the frequency of the repeatedly outputted help information in the set information storage circuit, help information can be outputted repeatedly according to the number of frequencies the user needs.

BRIEF DESCRIPTION OF THE DRAWINGS

A preferred form of the present invention is illustrated in the accompanying drawings in which:

FIG. 3 is a classification chart showing an example operation of a help information selection circuit in accordance with the present invention.

DETAILED DESCRIPTION OF THE PREFERRED EMBODIMENTS

Figure 1:
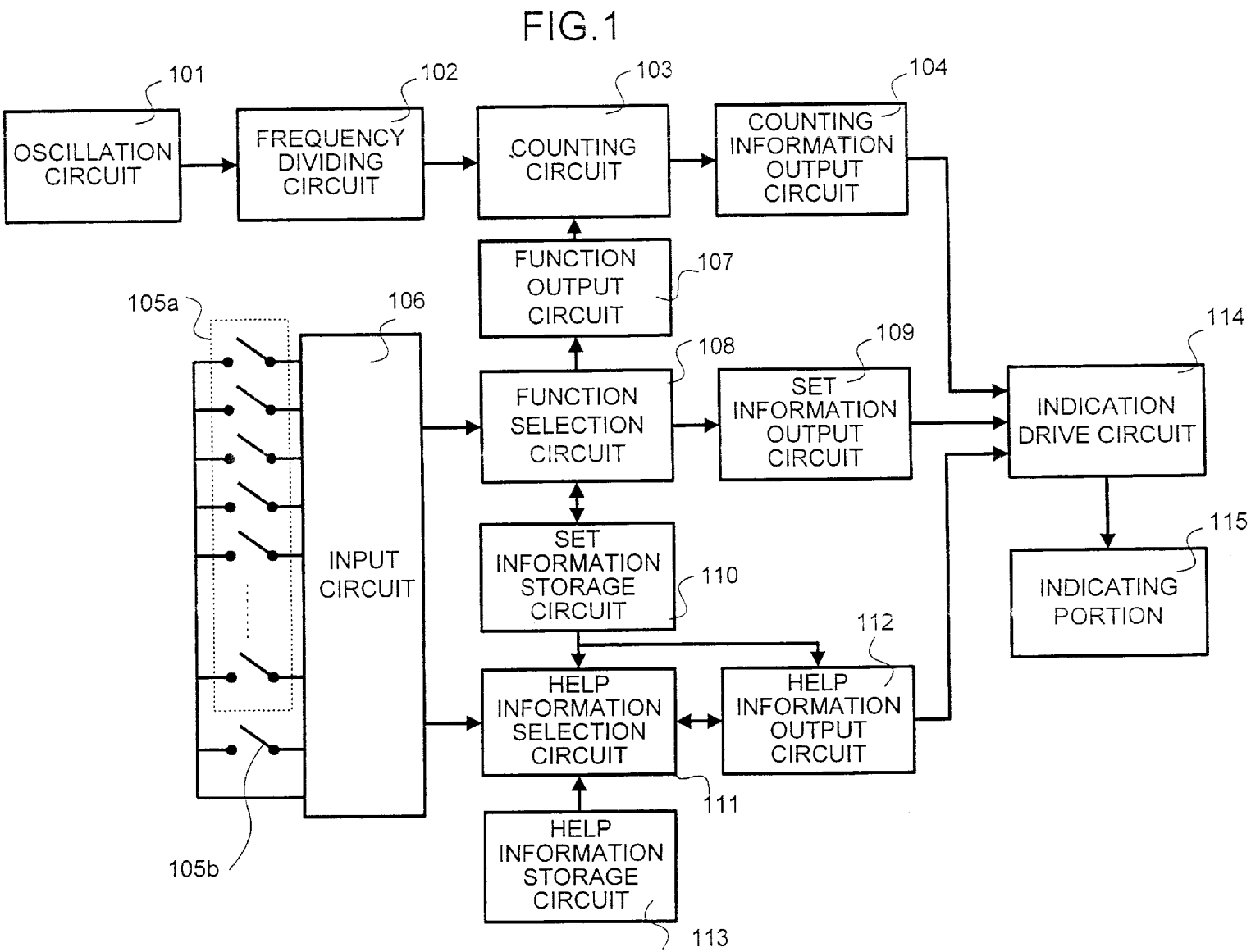
FIG. 1 is a functional block diagram showing an example of an electronic watch in accordance with the present invention.

FIG. 1 is a functional block diagram showing an example of a representative structure of this invention. An oscillation circuit 101 oscillates the oscillation signals having a fixed frequency. Inputted to a frequency dividing circuit 102 and through this frequency dividing circuit 102, the above-mention oscillation signals are divided into frequency dividing signals to form various frequency signals to be inputted to a counting circuit 103 where counting information such as time, chronograph, countdown timer, and the like is counted. Counted information counted by the counting circuit 103 is inputted to a counting information output circuit 104 and then converted into counting information output signals. These counting information output signals are inputted to an indication drive circuit 114 and then converted into indication drive signals. The indication drive signals are inputted into an indicating portion 115, and the indicating portion 115 indicates necessary information. A function switch 105*a* is provided for switching the modes of time, chronograph, countdown timer, and the like for conducting various types of settings in the respective modes. An input circuit 106 detects whether the function switch 105*a* was operated or not and which function switch 105*a* was operated for conversion to switch information. A set information storage circuit 110 stores modes and various types of set information. A function selection circuit 108 selects functions such as the correction operating function of the counting information and the start and stop counting function of the counting circuit 103 according to the set information stored in the set information storage circuit 110, and the switch information converted by the input circuit 106. Change and output requests for the set information stored in the set information storage circuit 110 are also performed by the function selection circuit 108. A function output circuit 107 outputs an operating command of a function selected by the function selection circuit 108 to the counting circuit 103. A set information output circuit 109 outputs the set information of the set information storage circuit 110 to the indication drive circuit 114 in which the counting information outputted by the counting information output circuit 104 has been inputted and the set information outputted by the set information output circuit 109 are converted into drive signals of the indicating portion 115. The indicating portion 115 in accordance with the drive signals of the indication drive circuit 114 then indicates the counted information and set information. The explanation of the operation contents of the above-mentioned FIG. 1 is consistent with that of the electronic watch according the conventional technology. When a user does not know how to operate the above-mentioned electronic watch and would like to refer to an operation method, the user can make references with the input of a help switch 105*b* serving as an external operation for requesting help information. In the following description, operation contents will be explained up to the point that help information is outputted. The help switch 105*b* is inputted and converted to switch information in which the help switch is inputted by the input circuit 106. Request for help information is then inputted to a help information selection circuit 111 in which selection for help information stored by the help information storage circuit 113 is carried out. The help information storage circuit 113 stores the help information constituted by character-string information describing the switch information and functions of the switch, which is classified in accordance with the mode and setting condition, the help information selected by the help information selection circuit 111 is then outputted from a help information output circuit 112 to the indication drive circuit 114 for conversion to drive signals of the indicating portion 115. Help information is indicated by the indicating portion 115 in accordance with the drive signals of the indicating drive circuit 114.

Figure 2:
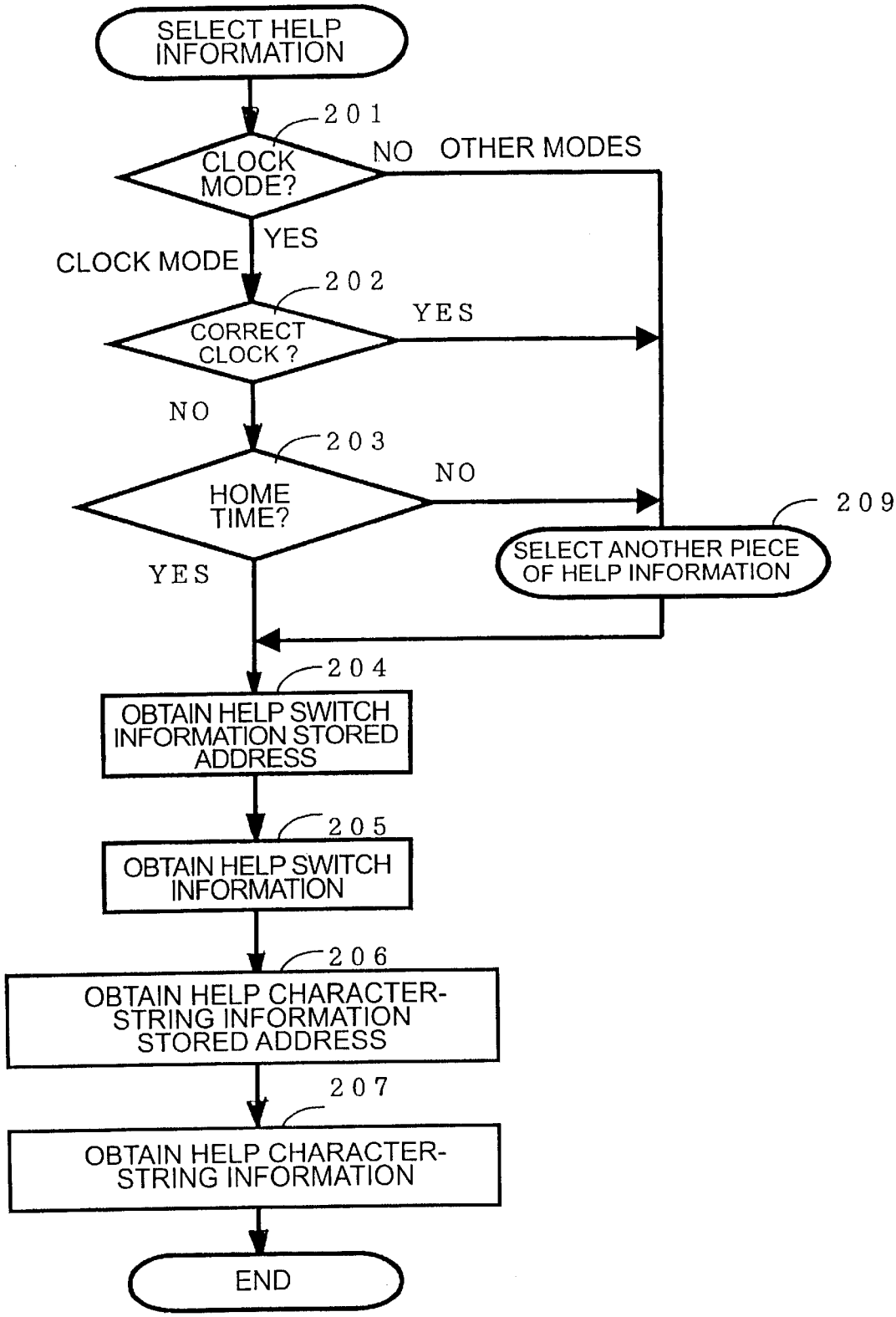
FIG. 2 is a flowchart showing an operation of a help information selection circuit in accordance with the present invention.

FIG. 2 is a flow chart showing an operation of the help information selection circuit 111. In FIG. 2, the help information selection circuit 111 determined whether the mode stored in the set information storage circuit 110 is a clock mode or not (201), and if it is other modes, it branches to the other help information selection (209). If the mode is a clock mode, determination is made whether the clock mode is in the correction state or not (202), and if it is, branches to the other help information selection (209). Whereas if not in the correction state, another determination is made whether the clock mode is home time or local time (203). If the clock mode is local time, it branches to the other help information selection (209). If it is home time, according to the mode and various setting conditions, the head address containing help switch information, which is one of the help information, is obtained (204). Likewise, the other help information formed of plural decisions and branches obtains the head address containing help switch information which is one of the help information according to the mode and various setting conditions (204). Next, help switch information is obtained by way of the above-mentioned head address (205). The help switch information, for instance, is nibble form data indicating the switch and the function switch 105*a* is composed of switch A, switch B, switch C, and switch D, and expressed in bits, then switch A is "0001b", switch B is "0010b", switch C is "0100b", and switch D is "100b". When the help switch information is lined in the order of switch C, switch D, switch A, and switch B, the head address is lined as "0100b", "1000b", "0001b", "0010b", and "0000b". "0000b" is the end code indicating the end of switch information and the order in which they are lined indicates also the order of the output of help information. When the help switch information is lined in the order of switch C, switch D, switch A, and switch B, the first information to be outputted is the help switch information of switch C. After obtaining help switch information (205), the head address is obtained in which help character-string information describing the switch information and functions of the switches according to the mode and various setting conditions is stored (206). Furthermore, help character-string information is obtained from the abovementioned head address (207). Here, the character data of the help character string information are expressed in bytes and encoded like ASCII. The end of help character-string information is indicated by an end code indicating an end.

The help switch information, the head address containing help switch information, the help character-string information, and the head address containing help character-string information are stored in the help information storage circuit 113. The help information selection circuit 111, according to the mode and various setting conditions, can obtain help switch information and help character-string information by acquiring the head address that contains help switch information and the head address that contains help character-string information.

FIG. 3 is a chart showing an example of the classified decisions and branches of the help information selection circuit 111. The help information that is to be outputted and the order of the output are classified corresponding with the mode and condition 1 and condition 2 of the mode as shown in FIG. 3. This classification shows the help switch information and the help character-string information that are to be acquired when the help information selection circuit 111 corresponds with each mode. Selected help information through mode, condition 1, and condition 2 has plural pieces of switch information with a one-to-one correspondence to the respective character-string information. The "LOCK" in condition 1 column means the watch is not in a correction state.

For instance, if right now the mode is time, condition 1 is LOCK, and condition 2 is home time respectively, then 4 help switch information and 4 help character-string information are selected. The order in which help information is outputted is as follows. The first help information outputted is the help switch information of switch C and the help character-string information of "For local time hold flashing pusher for 3 sec"; the second is the help switch information of switch D and the help character-string information of "For chime on/off press flashing pusher"; the third is the help switch information of switch A and the help character-string information of "For memo mode press flashing pusher"; and finally the fourth is the help switch information of switch B and the help character-string information of "To set time hold flashing pusher for 2 sec".

Figure 4:
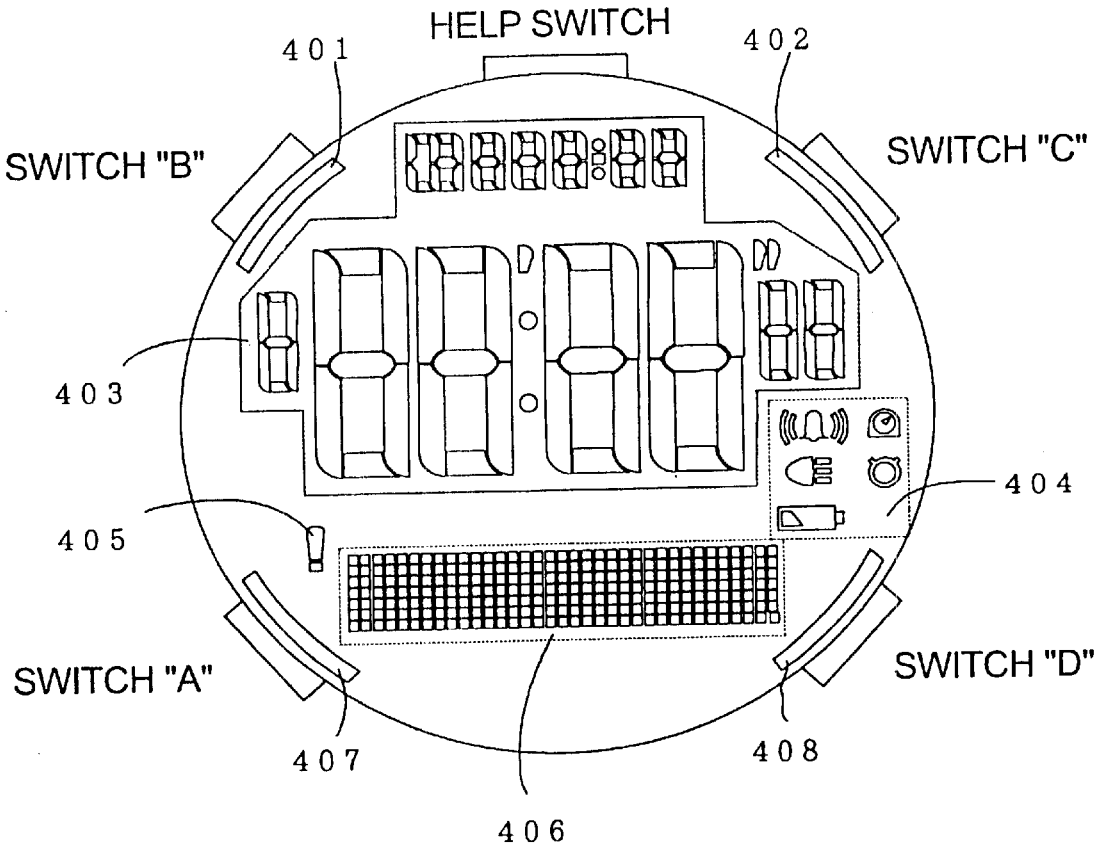
FIG. 4 is a diagram showing an example of an indicating portion in accordance with the present invention.

FIG. 4 is a diagram showing an example of an indicating portion of this invention. In FIG. 4, switch A, switch B, switch C, and switch D are the functional switches of the functional switch 105*a*. These switches are positioned in a manner that on the right side switch C and switch D oppose switch A and switch B on the left side respectively. The indicating factors 407, 401, 402, and 408 indicate the positions of switch A, switch B, switch C and switch D respectively. Counting information such as time, chronograph, timer, and the like outputted from the counting information output circuit 104 are indicated by a digit portion 403. An icon 404 shows the various setting conditions, and an icon 405 means that help information is being outputted. Help character-string information is indicated by a dot matrix portion 406, and when help information is not outputted, mode and various setting conditions are indicated instead thereof. To show an example of an indication, assuming that right now the mode is time, condition 1 is LOCK, and condition 2 is home time respectively. By operating the help switch 105*b* which is set on the upper side surface, the help information selection circuit 111 outputs the indication data of help switch information of switch C with the help character-string information of "For local time hold flashing pusher for 3 sec" to indication drive circuit 114 for conversion to indication drive signals. In accordance with these indication drive signals, an indicating portion 116 turns on the icon 405 and indicates that a help information is being outputted and also turns on the indicating element 402 to indicate the position of switch C. Furthermore, the dot matrix portion 406 indicates "For local time hold flashing pusher for 3 sec" and when a character-string information cannot be indicated in one time, the characters can be indicated by scrolling them from right to left. By following the chart in FIG. 3, similarly, help information will be indicated in that order. As for character scrolling, they will be explained in FIG. 6, FIG. 8, and FIG. 9.

Figure 5:
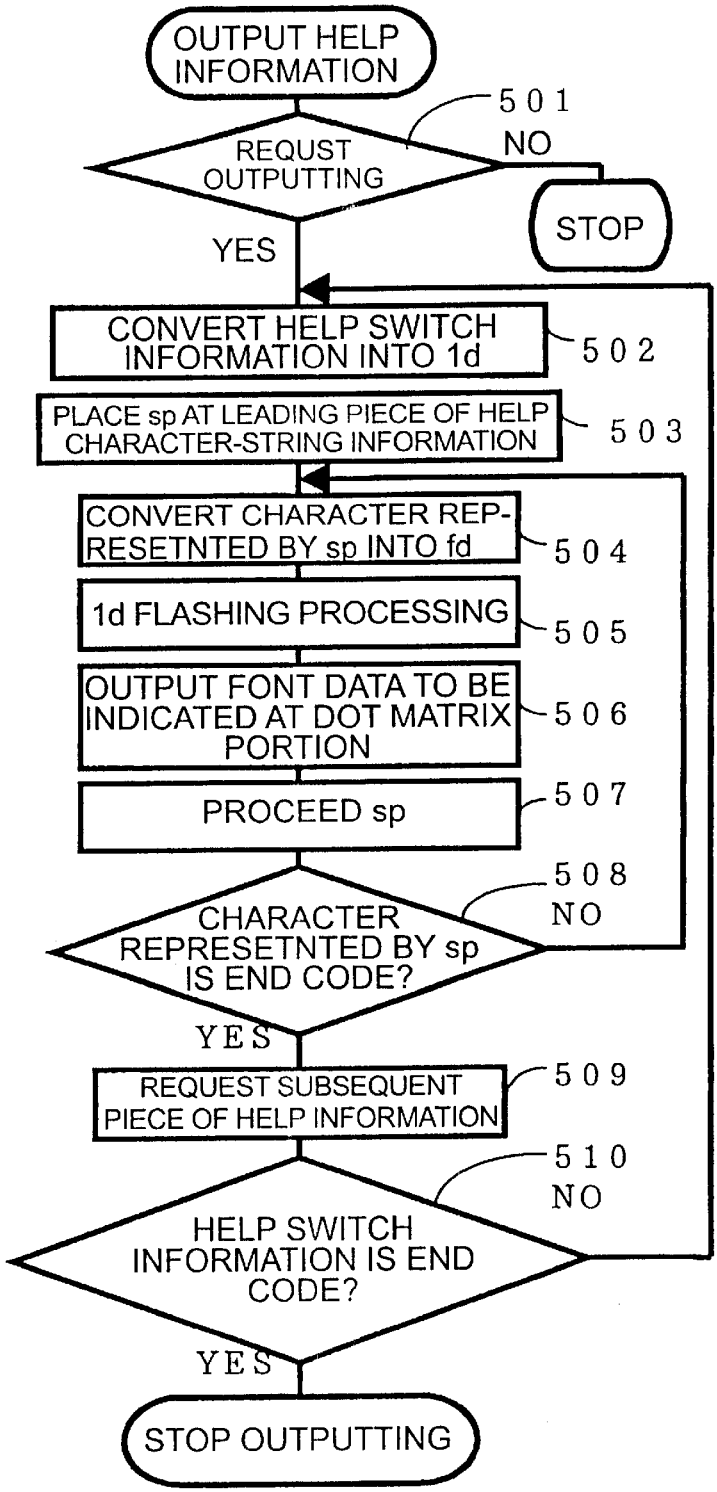
FIG. 5 is a flow chart showing an operation of a help information output circuit in accordance with the present invention.

FIG. 5 is a flow chart showing an operation of the help information output circuit 112. In FIG. 5, the help information output circuit 112 determines whether there is a request for output or not from the help information selection circuit 111 (501), and if not, then stops the output of help information. On the other hand, if there is a request for output, then help switch information is converted to indication data 1*d* that represents the switch position (502). Then, a pointer sp is placed at the leading letter of the help character-string information (503) and the leading letter that the pointer sp indicates is converted to the font data fd (504). The font data is made up of plural row by column binary coded data wherein data "1" turns on the indicating element of dot matrix portion 406 whereas data "0" turns the indicating element off. Next, the display data 1*d* which indicates the switch position converted at 502 and is outputted to the indicating drive circuit 114 (505) and the font data fd converted at 503 is also outputted to the indicating drive circuit 114 in order to be displayed on the dot matrix portion 406 (506). After the font data fd has been outputted, the character-string pointer sp moves on to the next character. When the character-string pointer sp indicates an end code, the operation proceeds to 509, or else it branches to 504 (508) and repeats operations 504 to 507. When an end code is indicated, the help information selection circuit 111 is requested for a subsequent piece of help information (509). Finally, if the help switch information is an end code, the output of help information stops and returns to the mode and setting conditions immediately before the help switch 105*b* was pressed (510). However, if the help switch information is not an end code, the operation branches to 502 (510) and request is made to the help information selection circuit 111 for the next help information, repeating operations 502 to 509.

The second point of difference is that various frequency signals outputted from the frequency dividing circuit 602 are inputted to the help information output circuit 612 so that according to the timing of a specific frequency having these various frequency signals, the characters of the help character-string information can be scrolled. Character scrolling operation will be explained in FIG. 8.

Figure 6:
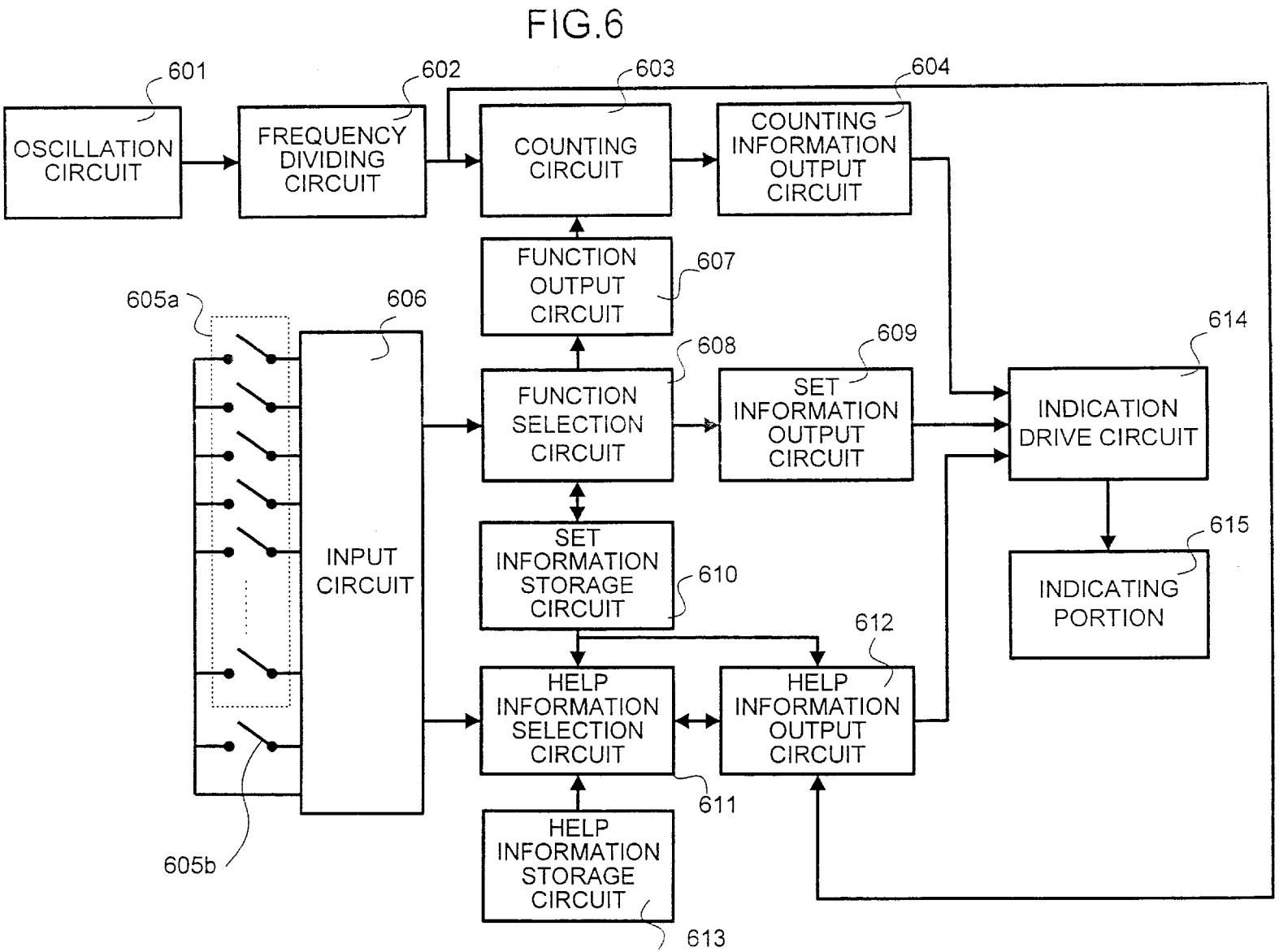
FIG. 6 is a functional block diagram showing an example of an electronic watch in accordance with the present invention.

FIG. 6 is a functional block diagram showing that the on/off of an indicating element indicating switch position and character-string scroll are possible. In FIG. 6 the same operation is conducted due to the same formation as that in FIG. 1. The first point of difference from FIG. 1 is that various frequency signals outputted from a frequency dividing circuit 602 are inputted to a help information output circuit 612 so that according to the timing of a specific frequency having these various frequency signals, the data which turns on or off the indicating element indicating switch position is outputted. The indicating element can also blink when the on/off operation is combined, which will be explained in FIG. 7.

In the third point of difference, in the state where a function selection circuit 608 can be set in a scrolling speed, the switch information is entered into the function selection circuit 608 by an input circuit 606, and the function selection circuit 608 selects a scrolling speed setting function to optionally change the scrolling speed information stored in a set information storage circuit 110. A help information output circuit 612 selects an optional frequency from the various frequency signals by the frequency dividing circuit 602 with the scroll speed information and sends characters by scrolling the character-string information according to the set timing.

The fourth point of difference is that by inputting a help switch 605*b*, an input circuit 606 outputs this switch information in which the help switch is inputted to a help information selection circuit 611 for selection of help information and for making a request to the help information output circuit 612 for help information output. The help information output circuit 612 receives the request for help information output. Before the help information output circuit 612 outputs a help information, by counting the various frequency signals outputted from the frequency circuit 602, the help information output circuit 612 can output information notifying the output of help information at a certain time to an indicating drive circuit 614. The operation to notify help information output is explained in FIG. 10.

Figure 7:
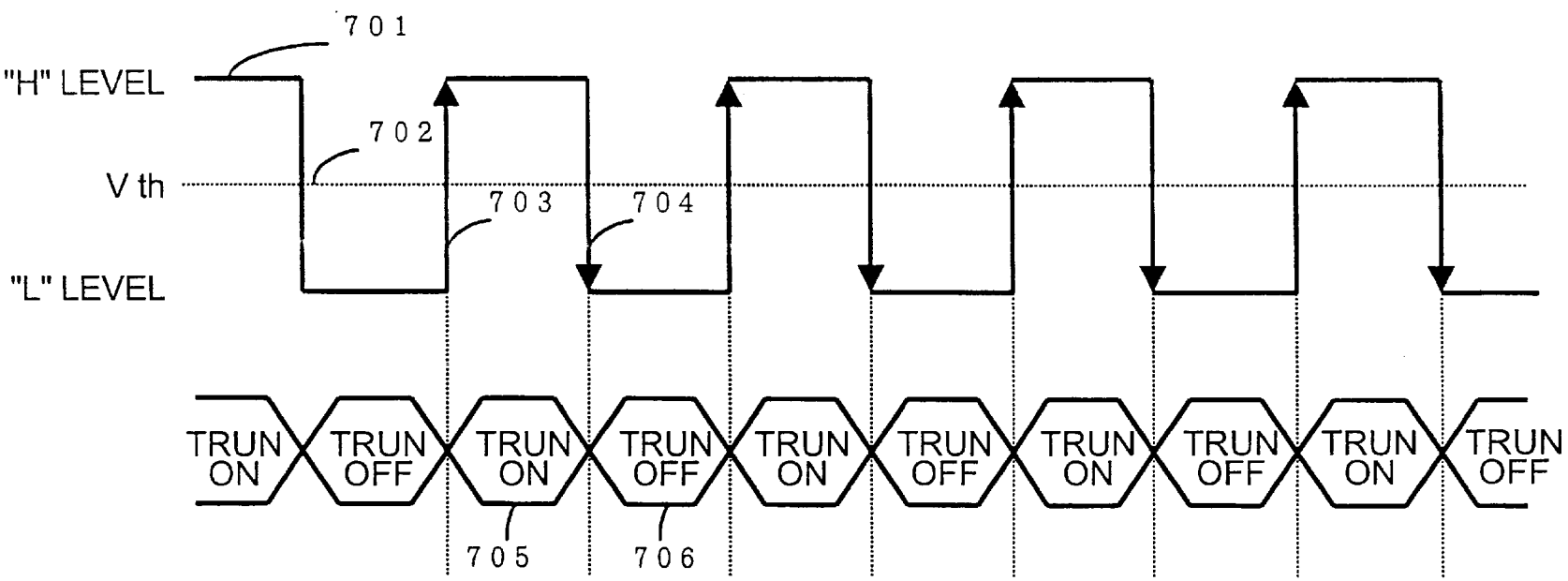
FIG. 7 is a time chart showing data output for a blinking indicating element indicating switch position in accordance with the present invention.

FIG. 7 is a time chart showing the output data for blinking the indicating element indicating switch position of the help information output circuit 612. In FIG. 7, among the various frequency signals outputted from the frequency dividing circuit 602, a clock 701 with a timing to activate the indicating element indicating switch position to blink, regulates a threshold level Vth7O2 using standards such as voltage, electric current, frequency and the like. Considering the threshold level Vth7O2 as the standard, a signal is divided into H and L levels, an H level when greater than threshold level Vth7O2 and an L level when lower than the threshold level Vth. When a signal 701 changes from L level to H level (703), the help information output circuit 612 determines that the signal is H level and therefore outputs a data 705 which turns on the indicating element indicating switch position. Conversely, when the signal changes from H level to L level (704), it determines that the signal is L level and a data 706 is outputted which turns off the indicating element indicating switch position. Repeating the turn-on and off (lights) operation leads to blinking.

Figure 8:
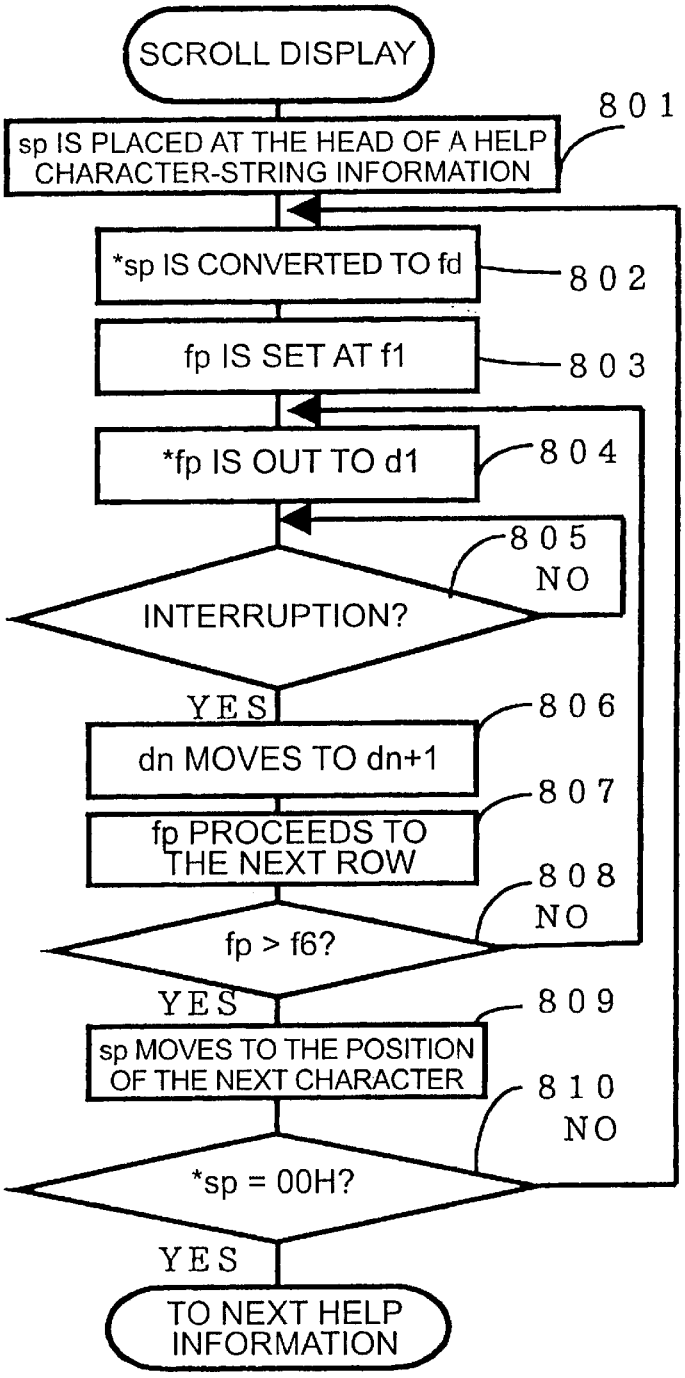
FIG. 8 is a flow chart showing a scroll operation of a help information output circuit in accordance with the present invention.
Figure 16:
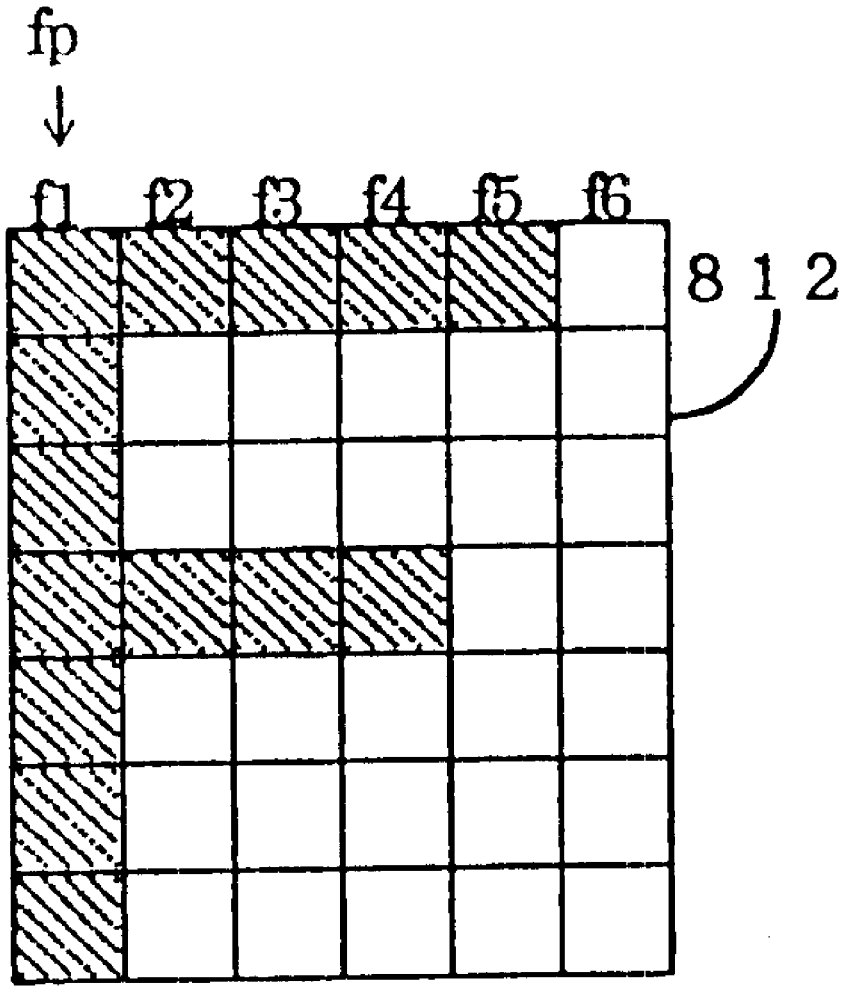
FIG. 16 is a diagram showing an example of font data in accordance with the present invention.
Figure 17:
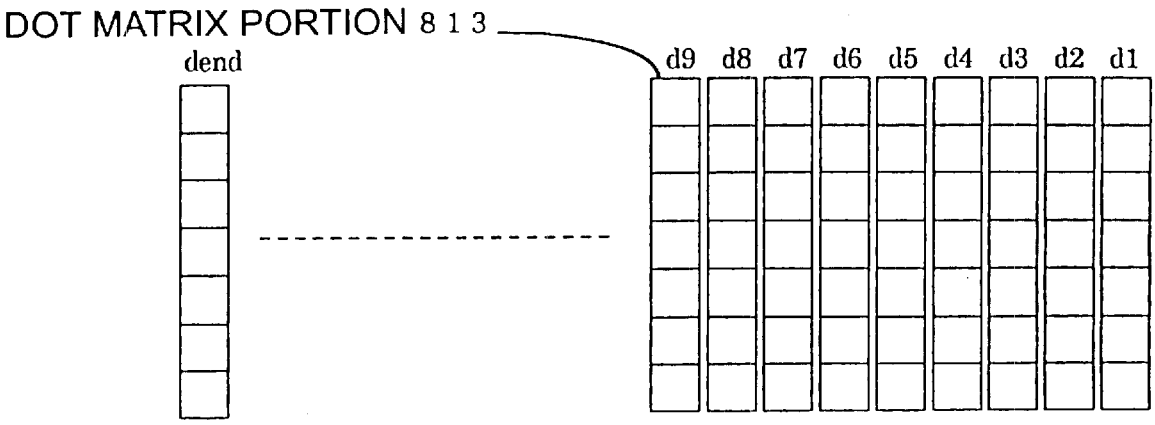
FIG. 17 is a diagram showing an example of a dot matrix portion in accordance with the present invention.

FIG. 8 is a flow chart showing an operation of a character-string information by scrolling the characters. A pointer sp indicating a character position is placed at the head of a help character-string information selected from the help information selection circuit 611 by the help output circuit 612 as shown in FIG. 8 (801). The character indicated by the pointer sp is converted to font data fd (802). In a case where a character "F" is indicated by the pointer sp, the font data is shown in FIG. 16. "On" data is where font data 812 hatching takes place whereas "off" data means there is no hatching. The font data fd is made up of plural row by column binary coded data wherein the on/off data are represented as binary codes, the highest bit from the top of the column of row f1 is "1111111b", of row f2 is "1001000b", of row f3 is "1001000b", of row f4 is "1001000b", of row f5 is "1001000b", and of row f6 is "0000000b". A row position indicator of fonts, a pointer fp is set at the leftmost row f1 of the font data fd (803) and the row of font data indicated by the pointer fp is outputted to the rightmost row d1 of a dot matrix portion 813 as shown in FIG. 17 (804). In the case of character 'F', the whole column of the dot matrix portion d1 row is turned on when the font data "1111111b" of row f1 is outputted. After 804, among the various frequency signals outputted from the frequency dividing circuit 612, a specific clock 811 determines the timing to scroll characters. An interruption is generated in the timing of fall time in which H level changes to L level of this clock 811. Waiting until there is an interruption (805), and when an interruption is generated, the data of row d1 of the dot matrix portion moves to row d2, row d2 data moves to row d3, row d3 data moves to row d4, and row data dn moves to row dn+1 (806). Next, the pointer fp which indicates the row of font data fd proceeds to the next row (807) and when the pointer fp exceeds rightmost row f6, the operation proceeds to 809 whereas when the pointer fp does not exceed rightmost row f6, the operation branches to 804 (808). Since the rightmost row f6 is the last row of font data fd, unless the pointer fp exceeds f6, steps 804, 805, 806, and 807 are repeated and font data representing rows f2, f3, f4, f5, and f6 are outputted to the dot matrix portion d1. Furthermore, the data of row of a dot matrix portion 813 is repeatedly shifted to the next left row in a sequential manner. However, when the pointer fp exceeds f6 and because the characters of font data fd indicated by the pointer sp are all outputted, the pointer sp moves to the position of the next character (809). When the character that the pointer sp indicates is end code "OOH", the operation proceeds to the next help information, otherwise the operation branches to 802 (810), meaning the character was not an end code. Further, comparison at 810 where the character is not an end code, the operations of 802, 803, 804, 805, 806, 808, and 809 are repeated until help character-string information output ends. On the other hand, at the comparison of 810 where the character is an end code, the help information output circuit 612 makes a request to the help information selection circuit 611 for subsequent help information since it has been determined that help character-string information output has stopped.

Figure 18:
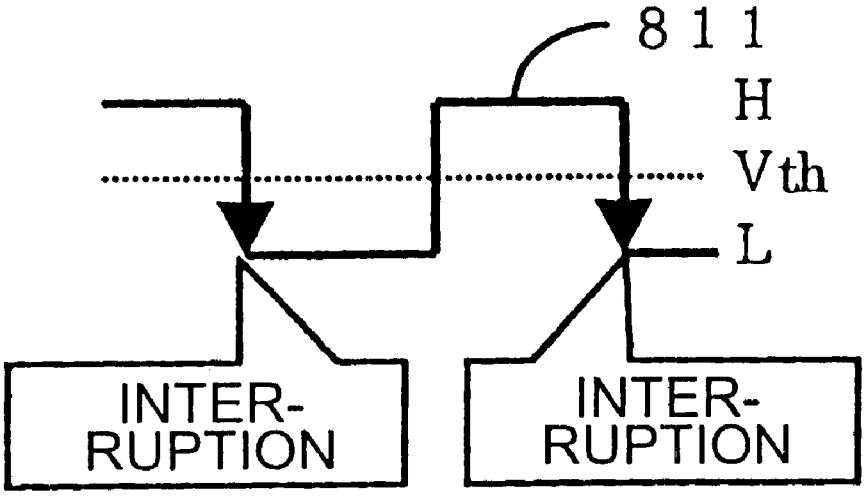
FIG. 18 is a diagram showing an example of timing of clock in accordance with the present invention.

In the state where the function selection circuit 608 can be set in a scrolling speed, the scroll speed information stored in the set information storage circuit 610 can be optionally changed. As for the timing at which the interruption is generated at 805, as shown in FIG. 18 and as mentioned above, an interruption is generated in the timing of fall time in which H level changes to L level of the clock 811, however, both the rise time and fall time and the timing of the fall time in which L level changes to H level are possible.

Figure 9:
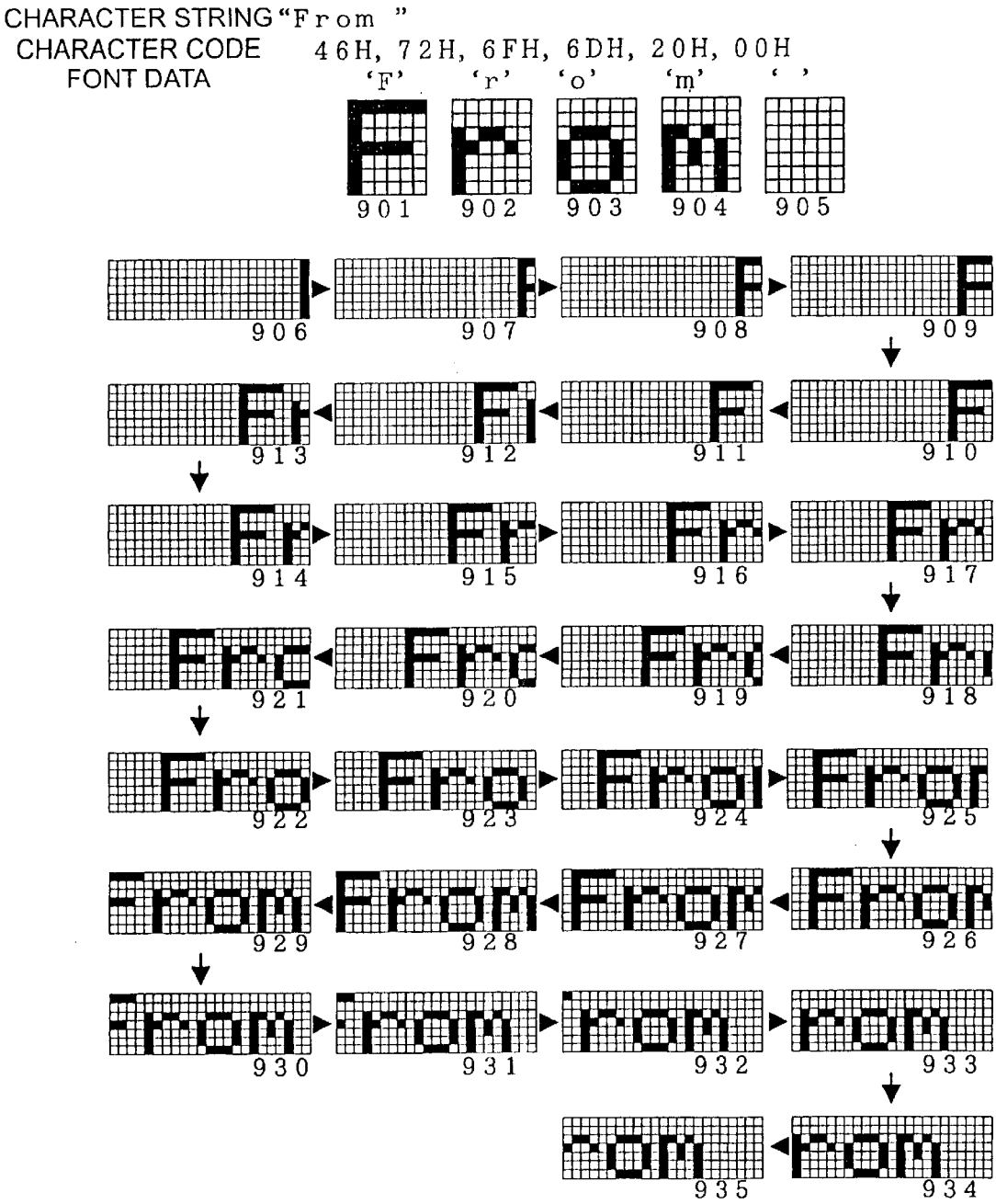
FIG. 9 is a diagram showing an example of a dot matrix portion character scroll output in accordance with the present invention.

FIG. 9 is a diagram showing an example of character scroll output of a dot matrix portion. In FIG. 9, when the help character-string information is "From", the following character codes are lined in the order of 'F' is "46H", 'r' is "72H", 'o' is "6FH", 'm' is "6DH", space is "20H", and end code is "OOH", Data 'F', 'r', 'o', 'm' and space are 901, 902, 903, 904, and 905 data, respectively. First, the character pointer sp is set at 'F' (801) and the pointer fp which indicates font data row position is set at leftmost row of font data 901 (803). Then the row of font data indicated by the pointer fp is outputted to the rightmost row of the dot matrix portion (906). As indicated by 805, the help information output circuit 612 waits for an interruption, and when an interruption is generated, from the leftmost row of the dot matrix portion the second data is moved to the first leftmost row, the third data is moved to the second leftmost row from the leftmost row of the dot matrix portion and so forth. Next, from the rightmost row of the dot matrix portion, the first data is moved to the second rightmost row. Shifting is repeated in sequence from the left side row (806), the pointer fp proceeds to the second font data in the right side row (807), and the row of font data indicated by the pointer fp is outputted to the rightmost row of the dot matrix portion (907). The operations of shifting a row of the dot matrix portion (806) due to the timing of interruption shown by 805 and of proceeding the pointer fp (807) so as to output the row of font data indicated by the fp to the rightmost row of the dot matrix portion (908, 909, 910, 911), are repeated unless the pointer fp exceeds the leftmost row of font data 901. In a case when the pointer fp exceeds the leftmost row of font data 901, the pointer sp moves to the next character 'r' (809) and is set at the rightmost row of font data 902 (803), and the row of font data indicated by the pointer fp is outputted to the rightmost row of the dot matrix portion (812). After the output of font data, with operations the same as the above-mentioned character 'F', the shifting of rows are repeated from the left side of the dot matrix portion (806). Next, the operations of moving the pointer fp to the next character (807) and outputting the row of font data to the rightmost row of the dot matrix portion (913, 914, 915, 916, 917) (804) are repeated. In a case when the pointer fp exceeds the rightmost row of font data 902, the pointer sp moves to the next character 'o' (809), sets the pointer fp at the leftmost row of font data 903 (803), and the row of font data indicated by the pointer fp is outputted to the rightmost row of the dot matrix portion (912). After the output of font data, with operations the same as the above-mentioned character 'F', the shifting of rows are repeated from the left side of the dot matrix portion (806). Next, the operations of moving the pointer fp to the next character (807) and outputting the row of font data to the rightmost row of the dot matrix portion (919, 920, 921, 922, 923) (804) are repeated. In a case when the pointer fp exceeds the rightmost row of font data 903, the pointer sp moves to the next character 'm' (809) and is set at the leftmost row of font data 904 (803), and the row of font data indicated by the pointer fp is outputted to the rightmost row of the dot matrix portion (924). After the output of font data, with operations the same as the above-mentioned character 'F', the shifting of rows is repeated from the left side of the dot matrix portion (806). Next, the ooperations of moving the pointer fp to the next character (807) and outputting the row of font data to the rightmost row of the dot matrix portion (925, 926, 927, 928, 929) (804) are repeated. In a case when the pointer fp exceeds the rightmost row of font data 904, the pointer sp moves to the next space (809) and is set at the leftmost row of font data 905 (803), and the row of font data indicated by the pointer fp is outputted to the rightmost row of the dot matrix portion (930). After the output of font data, with operations the same as the above-mentioned character 'F', the shifting of rows from the left side of the dot matrix portion (806) is repeated. Next, the operations of moving the pointer fp to the next character (807) and outputting the row of font data to the rightmost row of the dot matrix portion (931, 932, 933, 934, 935) (804) are repeated. Furthermore, when the pointer fp exceeds the rightmost row of font data 904, the pointer sp moves to end code (809) and the help information output circuit 612 requests help information selection circuit 611 for the next help information.

Figure 10:
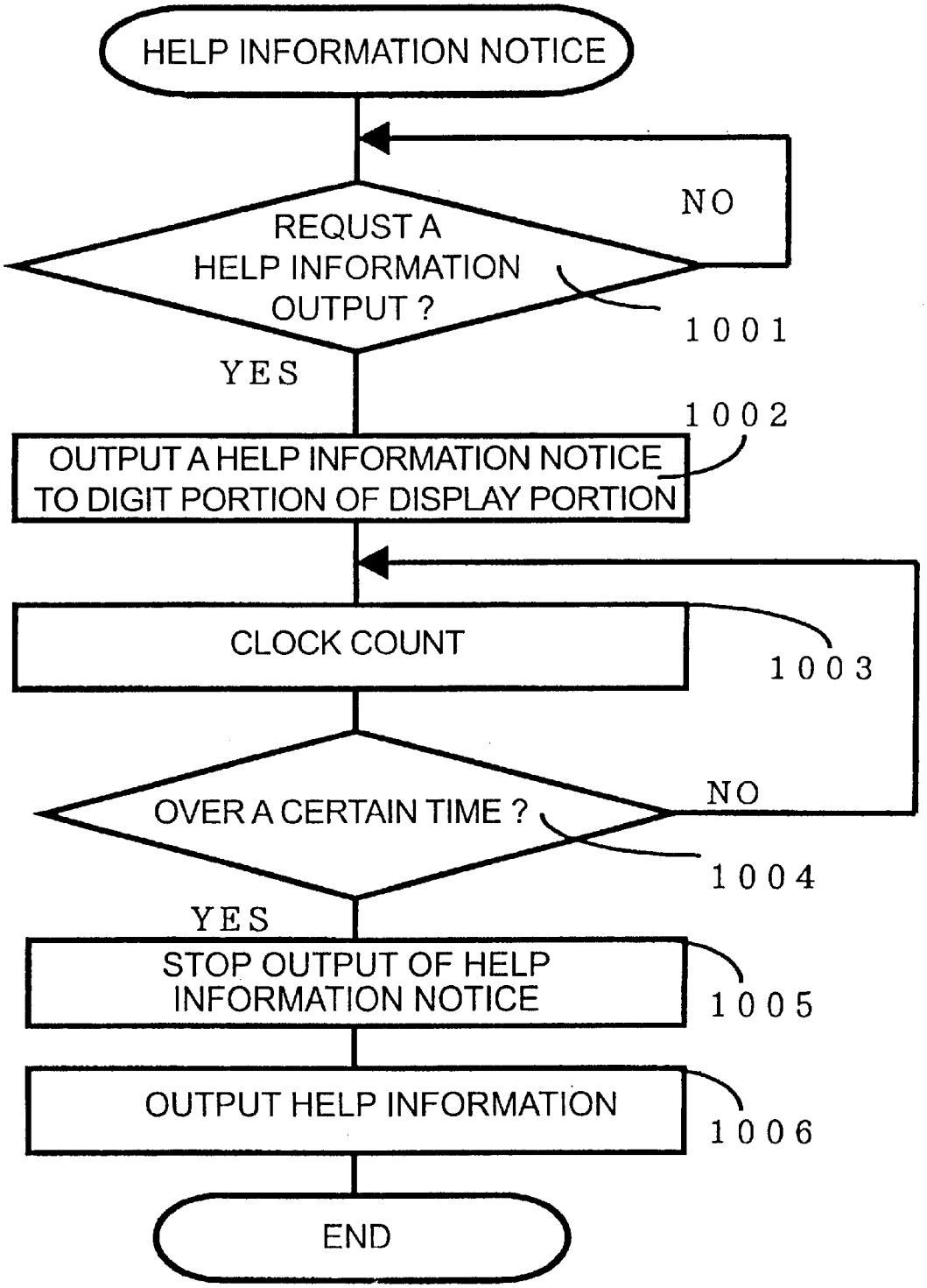
FIG. 10 is a flowchart showing an operation of a help information notice output in accordance with the present invention.

FIG. 10 is a flow chart showing the operations of a help information notice output. In FIG. 10, through the help information selection circuit 611, the help information output circuit 612 waits for a request to output help information (1001). When a request to output help information is made, the display data of a help information notice is outputted to the indicating drive circuit 614 to be displayed in a digit portion 1103 before help information is outputted in order to clearly distinguish the present mode and conditions (1002). Among the various frequency signals outputted from the frequency dividing circuit 602, a clock having a specific frequency counts (1003) the number of help information notice and returns to 1003 up to a certain time. Clock counting is conducted, and if a certain amount of time has elapsed, the operation will branch to 1005 (1004) and the output of help information notice will stop (1005). Help information selected by the help information selection circuit 611 is then outputted (1006).

Figure 11:
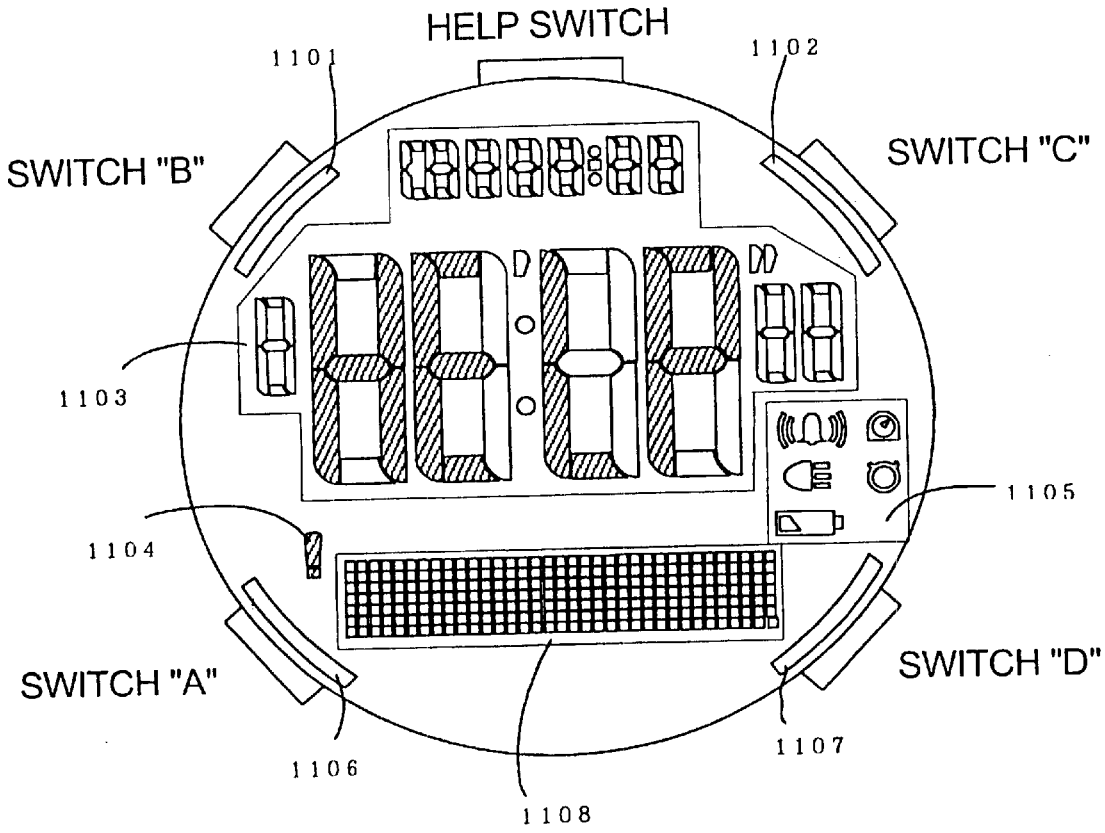
FIG. 11 is a diagram showing an example of a help information notice display in accordance with the present invention.

FIG. 11 is a diagram showing an example display of a help information notice. In FIG. 11, the part that is hatched indicates the help information notice, a digit portion 1103 indicates "HELP", and an icon 1104 indicates that help information is being outputted. A reason to light the digit portion 1103 is to be able to distinguish the next help information that is to be displayed from the one at a dot portion 1108 when help information notice is indicated in a dot portion 1106. Also, the notice indicator can turn on all the indicating elements (1101, 1102, 1106, 1108) which indicate the selected help switch position. Further, the turn on data can blink due to the timing of a clock with a specific frequency from among the various frequency signals outputted from the frequency dividing circuit 602 as explained in FIG. 7 the blinking operation of indicating elements wherein help switch position is indicated.

Figure 12:
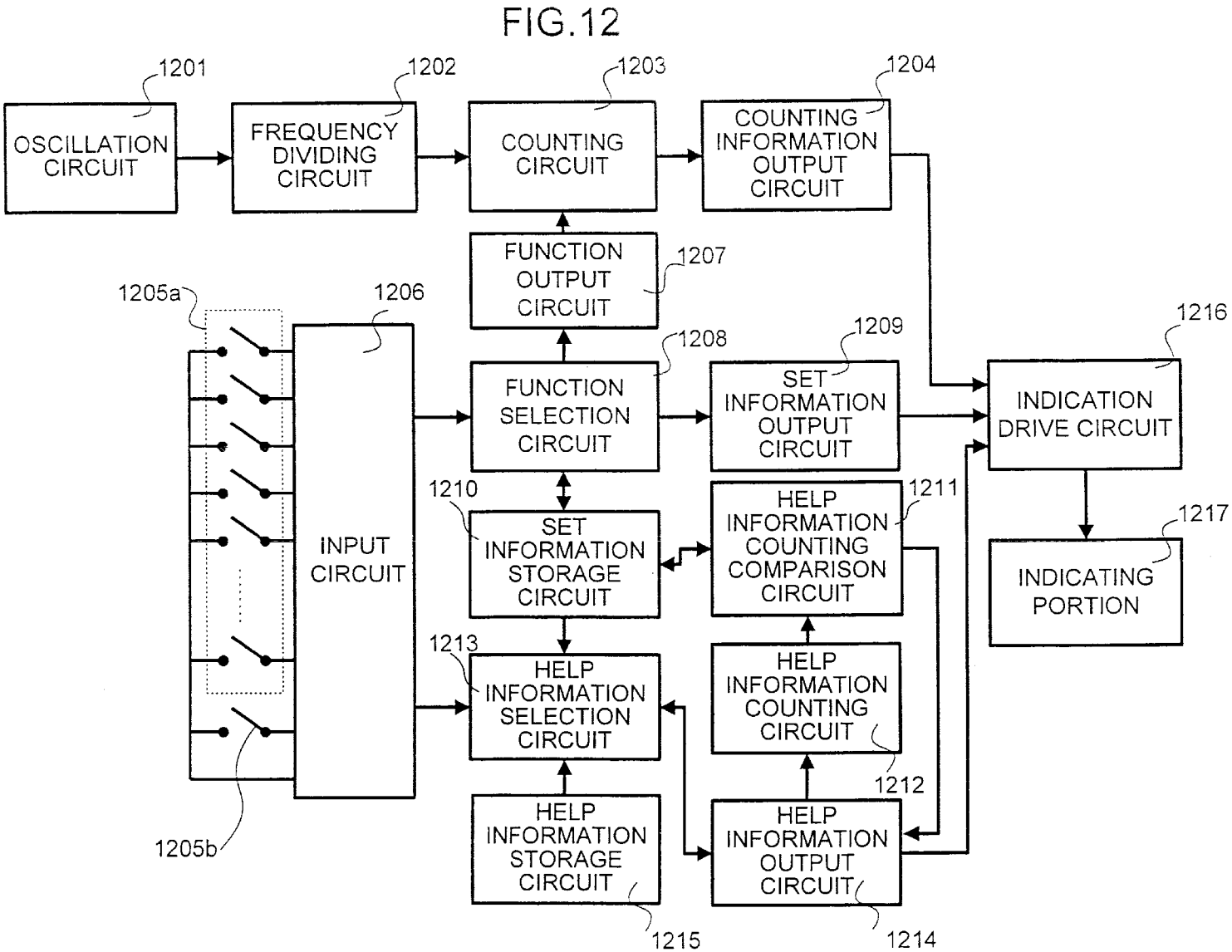
FIG. 12 is a functional block diagram showing an example of an electronic watch in accordance with the present invention.

FIG. 12 is a functional block diagram showing an example of an electronic watch according to the present invention. In FIG. 12, the difference with FIG. 1 is that the repeat frequency of help information output can be controlled owing to the construction in which means are added, such as a help information counting comparison circuit 1211 and a help information counting circuit 1212.

The following describes the help information counting comparison circuit 1211 and the help information counting circuit 121. First of all, if a help switch 1205*b* is inputted, an input circuit 1206 converts the inputted help switch to switch information and a request for help information is inputted to a help information selection circuit 1213 to select help information stored in a help information storage circuit 1215. Stored in the help information storage circuit 1215 is the help switch information which is classified in accordance with the mode and setting conditions, and the help information composed of help character-string information in which switch functions are described. A help information output circuit 1214 outputs help information selected by the help information selection circuit 1231 to an indicating drive circuit 1216. At a certain mode and setting condition when plural pieces of help information are selected, the help information output circuit 1214 completes to output a single piece of help information out of the selected help information. After this output, a request is made to the help information selection circuit 1213 for the next help information and help information is outputted one after another. The help information counting circuit 1212 makes a count after the plural pieces of help information selected by the help information selection circuit 1213 have been outputted once. A set information storage circuit 1210 stores beforehand the repeat frequency of help information as to the number of times the plural pieces of selected help information are to be outputted. The help information counting comparison circuit 1211 compares the count value counted by the help information counting circuit 1212 with the repeat frequency of help information, to thereby, if the repeat frequency is coincident therewith, output an output stop command to the help information output circuit 1214. If the repeat frequency is not coincident therewith, a command is outputted to the help information output circuit 1214 for another output of the plural pieces of selected help information. The help information output circuit 1214 will request the help information selection circuit 1213 for help information and output the help information that was initially displayed. When the help information counting comparison circuit 1211 compares the count value of the help information counting circuit 1212 with the repeat frequency of help information and the comparison coincides, then while outputting an output stop command of help information to the help information output circuit 1214, the mode and condition of set the information storage circuit 1210 are also set back to the state before help information was outputted. The value of the help information counting circuit 1212 is reset by the help information output circuit 1214 which receives a command to stop the output of help information. The help information stored in the set information storage circuit 1210 can be repeatedly outputted.

Secondly, in the state where a function selection circuit 1208 can be set in the repeat frequency of help information, when a functional switch 1205*a* is inputted, the switch information from the input circuit 1206 allows the function selection circuit 1208 to select a function for setting the repeat frequency of the help information to change the set value of the repeat frequency of the help information stored in the set information storage circuit 1210. The repeat frequency of help information is optionally set and the optional frequencies of help information can be outputted.

Thirdly, in a case where the help information storage circuit 1215 stores plural pieces of information in an optional mode and setting condition, when the help switch 1205*b* is inputted while the help information output circuit 1214 is outputting a single help information, then the input circuit 1206 outputs the switch information in which the help switch is inputted to the help information selection circuit 1213. Further, the help switch information selection circuit 1213 determines that the above-mentioned help information is being outputted, therefore another help information that is different from the above-mentioned help information is selected for output by the help information output circuit 1214 and the count value of help information counting circuit 1212 is reset. It is possible for the help information output circuit 1214 to output help information consecutively every input of the help switch 1205*b*.

Figure 13:
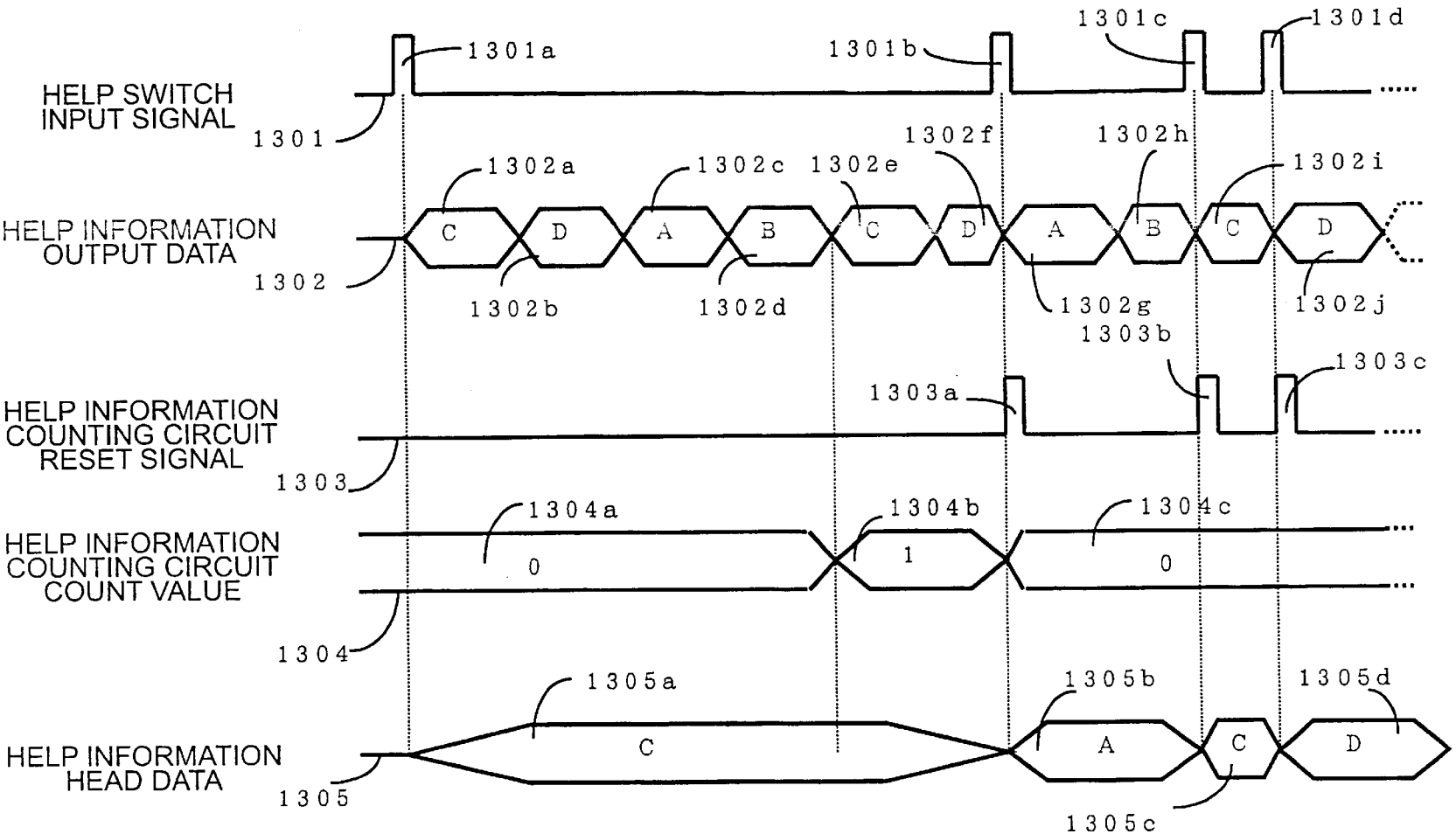
FIG. 13 is a functional block diagram showing an example of an electronic watch in accordance with the present invention.

FIG. 13 is a time chart showing the operation of FIG. 12 where the help switch 1205*a* is inputted while a help information is being outputted. In FIG. 13, the data of this time chart are a help switch input signal 1301, a help switch information data, a reset signal 1303 inputted by the help information counting circuit 1212, a count value 1304 of the help information counting circuit, and a head data 1305 of a help information. Referring to FIG. 3 in a state where time mode, LOCK, home time, and help are not outputted, when the help switch 1205*b* is inputted, the help information selection circuit 1213 obtains help information wherein help switch information is lined with switch C, switch D, switch A, switch B (1301*a*). The help information output circuit 1214 outputs the help information of switch C (1302*a*) and also stores the lead help information that was first outputted (1305*a*). The count value 1304 of help information counting circuit is '0' before any output, therefore when the output of help information of switch C is completed (1302*a*), the help information output circuit 1214 requests for the next help information to output the help information of switch D (1302*b*). Accordingly, when the output of help information of switch D is completed (1302*b*), the help information output circuit 1214 requests for the next help information to output the help information of switch A (1302*c*) and after the output of help information of switch A is completed (1302*c*), then the help information output circuit 1214 requests for the next help information to output the help information of switch B (1302*d*). Further, when the output of help information of switch B is completed (1302*d*), the help information output circuit 1214 requests for the next help information to output the help information of switch C (1302*e*). During this step, if the head data of the help information stored by the help information output circuit 1214 coincides with switch C determining that the help information has gone around once, one is added to the counted value (counted value+1) of the help information counting circuit 1212 (1304*b*). However, if the repeat frequency of help information is not 1, then the help information counting comparison circuit 1211 outputs a command for another output of help information, and the help information output circuit 1214 requests the help information selection circuit 1213 for a help information and outputs the initially displayed help information of switch C (1302*e*). After the completion of outputting the help information of switch C (1302*e*), the help information output circuit 1214 requests for the next help information to output the help information of switch D (1302*f*). If the help switch 1205*b* is inputted (1301*b*) during the output of help information of switch D (1302*f*), the help information selection circuit 1213 determines that help information is being outputted, and therefore requests for the output of the next help information. The help information output circuit 1214 completes the output of help information of switch D which is being outputted now (1302*f*), outputs the help information of switch A which is the next help information (1302*g*), and changes the lead help information to switch A (1305*b*). Further, the help information output circuit 1214 sends a reset signal to the help information counting circuit 1212 (1303*a*) for resetting the count value (1304*c*). As the output of help information of switch A is completed, the help information output circuit 1214 requests for the next help information to output the help information of switch B (1302*h*). If the help switch 1205*b* is inputted (1301*c*) during the output of help information of switch B (1302*h*), the help information selection circuit 1213 determines that help information is being outputted, hence, requests for the next output of the help information. The help information output circuit 1214 completes the output of help information of switch B which is being outputted now (1302*h*), outputs the help information of switch C which is the next help information (1302*i*), and changes the lead help information to switch C (1305*c*). Further, the help information output circuit 1214 sends a reset signal to the help information counting circuit 1212 (1303*b*) for resetting the count value (1304*c*). If the help switch 1205*b* is inputted (1301*d*) during the output of help information of switch C (1302*i*), the help information selection circuit 1213 determines that help information is being outputted, hence, requests for the output of the next help information. The help information output circuit 1214 completes the output of help information of switch C which is outputted now (1302*i*), outputs the help information of switch D which is the next help information (1302*j*), and changes the lead help information to switch D (1305*d*). Further, the help information output circuit 1214 sends a reset signal to the help information counting circuit 1212 (1303*c*) for resetting the count value (1304*c*). As explained in the time chart diagram in FIG. 13, every time help switch 1205*b* is inputted, the help information output circuit 1214 consecutively outputs help information.

Figure 14:
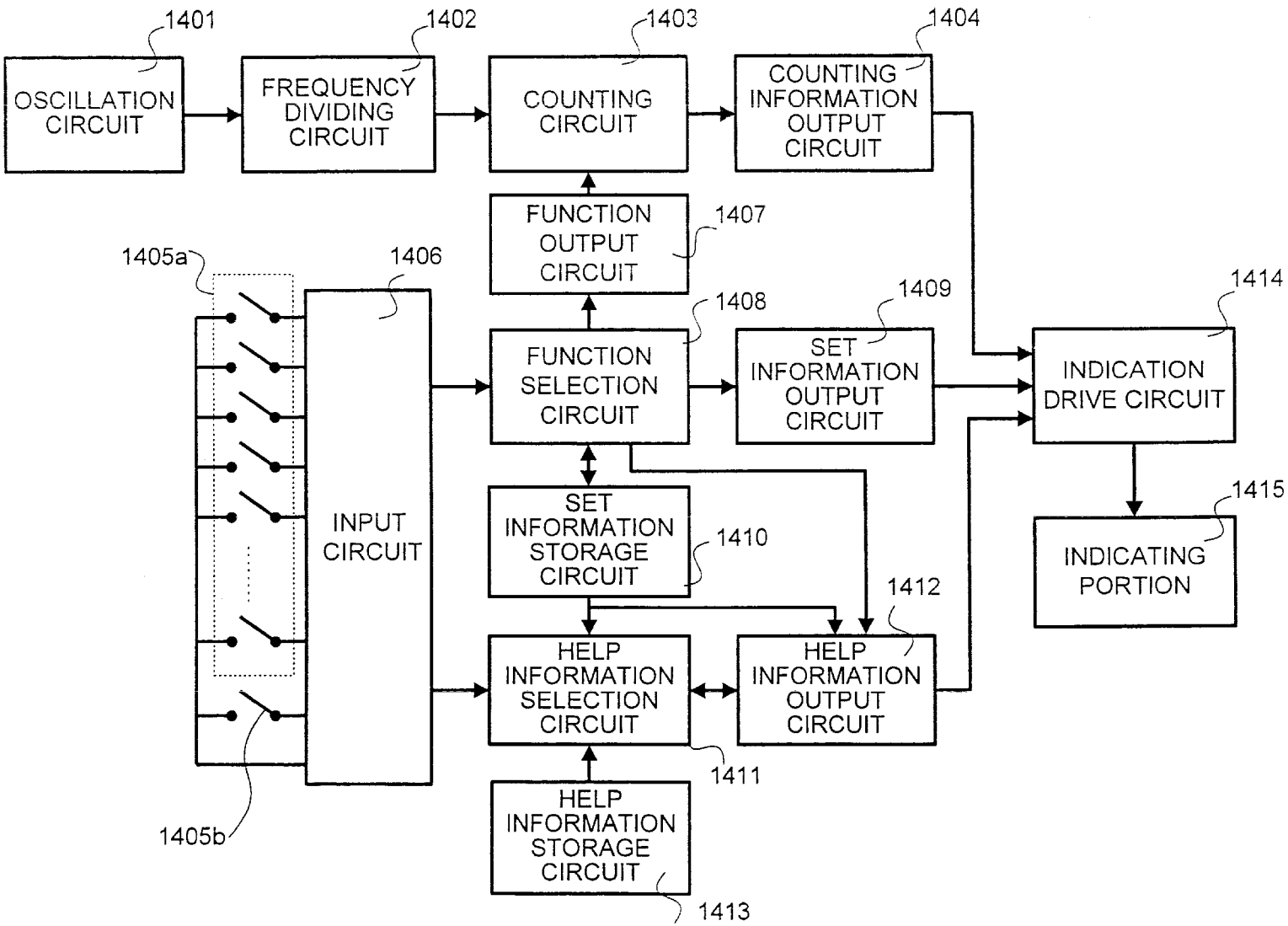
FIG. 14 is a functional block diagram showing an example of an electronic watch in accordance with the present invention.
Figure 15:
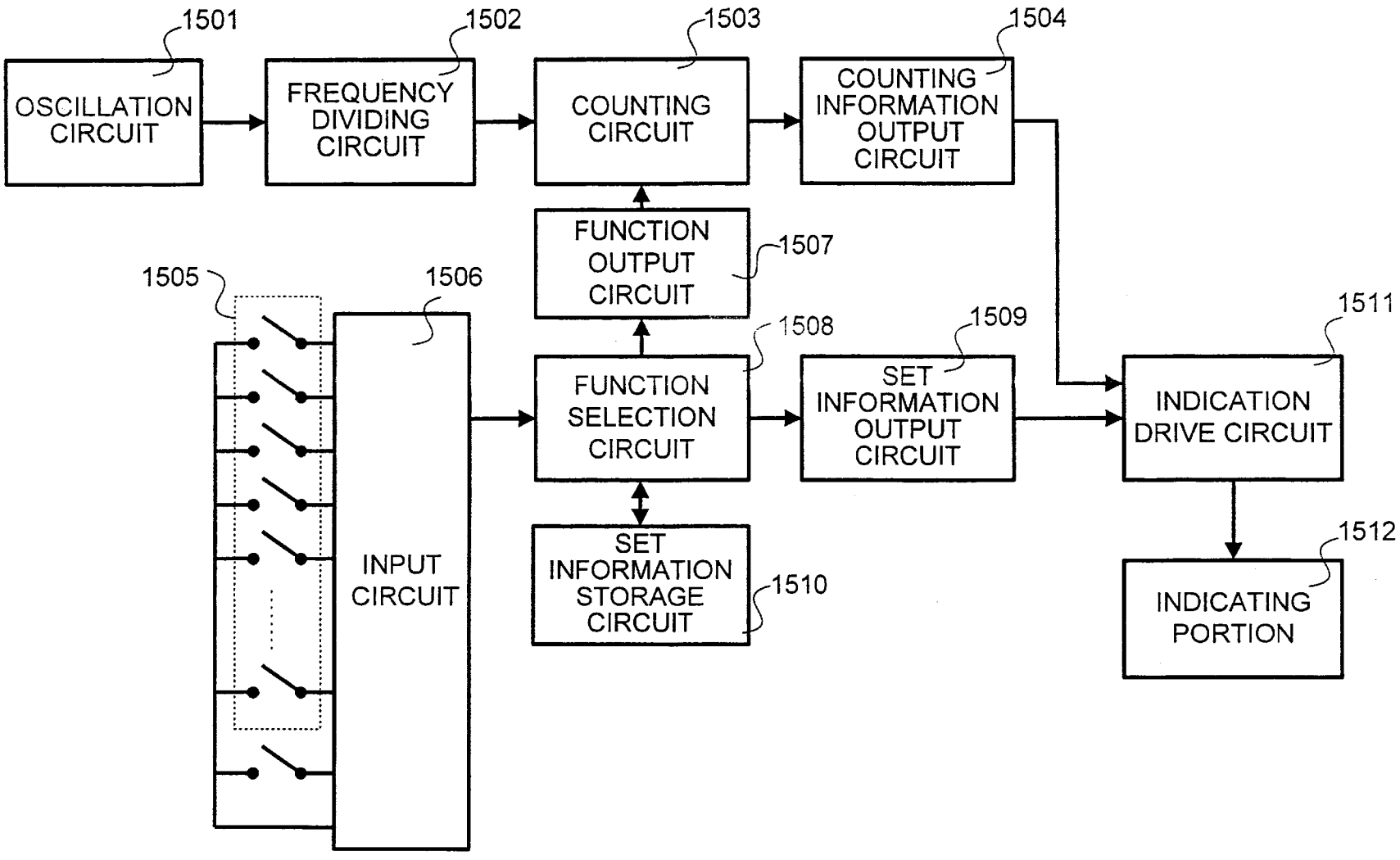
FIG.15 Prior Art
FIG. 15 is a functional block diagram showing a conventional electronic watch.

FIG. 14 is a functional block diagram showing an example of an electronic watch according to the present invention. The operation of FIG. 14 differs from that of FIG. 1 in that the request for help information output and help information output stop command can be outputted from the function selection circuit. The following describes the contents of this operation.

First of all, when the help information is outputted, if a functional switch 1405*a* being of operative-active is inputted, a function selection circuit 1408 outputs a help information output completion command to a help information output circuit 1412 and the help information output circuit 1412 completes an output of the help information. Additionally, the function selection circuit 1408 selects one of a count-start and count-stop function in a counting circuit 1403, a function of requesting a correction of counting information and the like, and a function of changing the set information of a set information storage circuit 1410 to thereby perform the respective functional operations. While the help information is being outputted, the functional switch 1405*a* being operation-active is inputted so that a command to complete an output of the help information is outputted.

Secondly, in any mode and setting condition, when the functional switch 1405*a* being operation-inactive is inputted, switch information being operation-active is outputted to a function selection circuit 1407 by an input circuit 1406. If the function selection circuit 1407 determines that it is operation-active, then the function selection circuit 1407 outputs a help information output start command to the help information output circuit 1412. The help information output circuit 1412 makes a request to a help information selection circuit 1411 for help information and the help information selection circuit 1411 selects the help information from a help information storage circuit 1413 in accordance with the mode and setting condition. The help information output circuit 1412 outputs the selected help information with the functional switch 1405*a* being operated inactively regardless of an input of the help switch 1405*b*.

As described above, since the help information selection information output circuit, the help information output circuit, and the help information comparison circuit are composed of ROM by programmed microcomputers, the functions of these circuits can be realized when the CPU carries out the calculation process, when help information storage circuit data is stored in the ROM, and also when help information counting circuit is a counter.

The present invention is implemented by the above-described embodiments. An electronic watch comprising an oscillation circuit 101, a frequency dividing circuit 102, a counting circuit 103, a counting information output circuit 104, a functional switch 105*a*, a help switch 105*b*, an input circuit 106, a function output circuit 107, a function selection circuit 108, a set information output circuit 109, a set information storage circuit 110, a help information selection circuit 111, a help information output circuit 112, a help information storage circuit 113, an indication drive circuit 114, and an indicating portion 115 allows a user to immediately identify an anticipated operation when the user does not know of such operation, and to immediately identify an operating method without having to carry an operating manual.

Incorporating the repeat display of help information satisfies a user's request to repeatedly display a help information. Furthermore, even if a user cannot read the help information, it is possible to read the help information without operating from the beginning.

Even if help information cannot be displayed together, words and phrases do not have to be omitted in the limited area of display. By scrolling help information, comprehensible help information can be displayed for the user.

By flashing relevant information, a user is made conscious that the help information is being outputted and being displayed.

By optionally setting the scroll speed, each user can read the help information at his speed. Furthermore, it is possible to indicate help information understandably for a user and to enhance information the comprehensiveness of the help information by the user.

A user can recognize that help information is in the indicated state, by indicating a notice. Also, it is possible to verify that the help information is now in the indicated state.

What is claimed is:

1. An electronic timepiece comprising:

a help switch for switching between a help state and a non-help state;

input means for converting the state of the help switch into switch information;

a help information storage circuit for storing help information;

a set information storage circuit for storing a current setting condition of the electronic timepiece;

help information selection means for verifying the current setting condition from the set information storage circuit when the switch information from the input means is entered, and for selecting help information from the help information stored in the help information storage circuit in accordance with the current setting condition;

help information output means for outputting the help information selected by the help information selection means;

indication drive means for converting the help information outputted from the help information output means into an indication signal; and indicating means for indicating the indication signal of the indication drive means.

2. An electronic timepiece as claimed in claim 1; wherein the help information selection means includes means for selecting a plurality of pieces of help information when the help switch is switched to a help state; wherein when the help information selection means selects the plurality of pieces of information, the help information output means outputs each of the pieces of help information successively one after another.

3. An electronic timepiece as claimed in claim 2; wherein when the help information output means outputs all of the pieces of help information, the setting condition of the electronic timepiece prior to the help switch being switched to the help state is restored.

4. An electronic timepiece as claimed in claim 1; wherein the indicating means includes means for indicating identification information for identifying the help state or the non-help state.

5. An electronic timepiece as claimed in claim 2; wherein the indicating means includes means for indicating the indication signal corresponding to information associated with the plurality of pieces of help information.

6. An electronic timepiece as claimed in claim 5; wherein the indicating means includes means for indicating the information by flashing the information.

7. An electronic timepiece as claimed in claim 1; wherein the indicating means includes means for indicating the help information selected by the help information selection means by scrolling the help information.

8. An electronic timepiece as claimed in claim 7; wherein when the input means outputs to the help information selection means switch information indicating that the help switch has been switched, the help information selection means selects a scrolling speed setting function to selectively change a scrolling speed stored in the set information storage circuit and the help information output means outputs the help information at the selected scrolling speed.

9. An electronic timepiece as claimed in claim 1; wherein in a state where no help information is outputted after the help switch is switched, the input means outputs to the help information selection means switch information indicating that the help switch has been switched, the help information selection means selects help information and requests a help information output to the help information output means, and the help information output means outputs notice information on the help information output for a certain period of time before outputting the help information.

10. An electronic timepiece as claimed in claim 2; wherein in any setting condition, when every piece of help information selected by the help information selection means is outputted, the initially indicated help information is returned and repeatedly indicated.

11. An electronic timepiece as claimed in claim 3; wherein the set information storage circuit includes means for storing a repeat frequency of outputting help information; and further comprising a help information counting circuit for counting a frequency of outputting the help information; and a help information counting comparison circuit for comparing the repeat frequency stored in the set information storage circuit with a count value of the help information counting circuit, to thereby, if the count value is coincident therewith, output an output stop command of the help information, while if the count value is not coincident therewith, to return to the initially indicated help information to repeatedly request for a fixed number of times an output of the help information.

12. An electronic timepiece as claimed in claim 10; wherein the set information storage circuit includes means for storing a repeat frequency of outputting help information; and further comprising a help information counting circuit for counting a frequency of outputting the help information; and a help information counting comparison circuit for comparing the repeat frequency stored in the information storage circuit with a count value of the help information counting circuit, to thereby, if the count value is coincident therewith, output an output stop command of the help information, while if the count value is not coincident therewith, to return to the initially indicated help information to repeatedly request for a fixed number of times an output of the help information.

13. An electronic timepiece as claimed in claim 11; wherein when switch information from the input means is entered, the help information selection means selects a function for setting a repeat frequency of the help information to change a value of the repeat frequency of the help information stored in the help information storage circuit.

14. An electronic timepiece as claimed in claim 12; wherein when switch information from the input means is entered, the help information selection means selects a function for setting a repeat frequency of the help information to change a value of the repeat frequency of the help information stored in the help information storage circuit.

15. An electronic timepiece as claimed in claim 11; wherein in any setting condition, when the help information selection means selects a plurality of pieces of help information and the help information output means outputs one of the pieces of help information out of the selected pieces of help information, if the help switch is switched, the input means outputs to the help information selection means switch information indicating that the help switch has been switched, and the help information selection means determines that the help information is being outputted by the help information output means to thereby request an output of another of the pieces of help information different from said one piece of help information.

16. An electronic timepiece as claimed in claim 12; wherein in any setting condition, when the help information selection means selects a plurality of pieces of help information and the help information output means outputs one of the pieces of help information out of the selected pieces of help information, if the help switch is switched, the input means outputs to the help information selection means switch information indicating that the help switch has been switched, and the help information selection means determines that the help information is being outputted by the help information output means to thereby request an output of another of the pieces of help information different from said one piece of help information.

17. An electronic timepiece as claimed in claim 1; wherein in a state where no help information is outputted after the help switch is switched, the help information selection means outputs a help information output completion command to the help information output means to complete an output of help information.

18. An electronic timepiece as claimed in claim 1; wherein in any setting condition of the electronic timepiece after the help switch is switched, the input means outputs the switch information to the help information selection means, the help information selection means outputs a help information output start command to the help information output means and selects the help information from the help information storage circuit in accordance with the setting condition, and the help information output means outputs the selected help information.

19. An electronic timepiece comprising:

a switch for switching between a help state and a non-help state;

an input circuit for converting the state of the switch into switch information;

a first storage circuit for storing help information;

a second storage circuit for storing setting condition information of the electronic timepiece;

a selection circuit for selecting help information from the help information stored in the first storage circuit in accordance with switch information from the input circuit and the setting condition information stored in the second storage circuit;

an output circuit for outputting the help information selected by the selection circuit;

a drive circuit for converting the help information outputted from the output circuit into an indication drive signal; and an indicator for indicating the indication drive signal of the indication drive circuit.

* * * * *